US009840097B2

(12) United States Patent
Nohara et al.

(10) Patent No.: US 9,840,097 B2
(45) Date of Patent: Dec. 12, 2017

(54) PRINTER

(71) Applicant: Brother Kogyo Kabushiki Kaisha, Nagoya-shi, Aichi-ken (JP)

(72) Inventors: Shuhei Nohara, Kasugai (JP); Ryohei Murabayashi, Mie-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/267,434

(22) Filed: Sep. 16, 2016

(65) Prior Publication Data

US 2017/0080721 A1 Mar. 23, 2017

(30) Foreign Application Priority Data

Sep. 18, 2015 (JP) ..... 2015-185807

(51) Int. Cl.

| | |
|---|---|
| ***B41J 13/00*** | (2006.01) |
| ***B41J 23/02*** | (2006.01) |
| ***B41J 29/38*** | (2006.01) |
| ***G03G 15/00*** | (2006.01) |

(52) U.S. Cl.

CPC ..... *B41J 23/025* (2013.01); *B41J 29/38* (2013.01); *G03G 15/80* (2013.01)

(58) Field of Classification Search

CPC ..... B41J 13/0009; B41J 13/00; B41J 11/42; B41J 11/0095; B41J 15/046; B41J 15/044; B41J 15/04; B41J 15/00; B41J 15/048; B41J 15/16; B41J 23/025; B41J 29/38; B41J 2/04548; B41J 2/04555; B41J 2/0457; B41J 2002/022; B41J 2/0452; B41J 29/393; B41J 2/04501; B41J 29/387; G03G 15/80

See application file for complete search history.

(56) References Cited

U.S. PATENT DOCUMENTS

| | | | | |
|---|---|---|---|---|
| 8,885,367 | B2 * | 11/2014 | Busch | H02M 1/126 363/39 |
| 9,285,866 | B2 * | 3/2016 | Iguchi | G06F 1/3284 |
| 2003/0202296 | A1 * | 10/2003 | Hamano | H02H 9/001 361/2 |

FOREIGN PATENT DOCUMENTS

| | | |
|---|---|---|
| JP | H03-015234 A | 1/1991 |
| JP | H07-147166 A | 6/1995 |
| JP | 2003-103871 A | 4/2003 |

* cited by examiner

*Primary Examiner* — Kristal Feggins
(74) *Attorney, Agent, or Firm* — Banner & Witcoff, Ltd.

(57) ABSTRACT

The disclosure discloses a printer including a load circuit, a controller, a power receiving terminal, a first switching circuit, and a second switching circuit. The controller is configured to control voltage supply to the load circuit, and is connected to an input part. The power receiving terminal is configured to be connected to a power feeding terminal of an external power source device. The first switching circuit includes a first switch element configured to switch between conduction and interruption in accordance with a first control signal input from the controller, and is connected between the power receiving terminal and the input part. The second switching circuit includes a second switch element configured to switch between conduction and interruption in accordance with a second control signal input from the controller, and is connected between the battery storage part and the input part.

11 Claims, 6 Drawing Sheets

[FIG. 1]
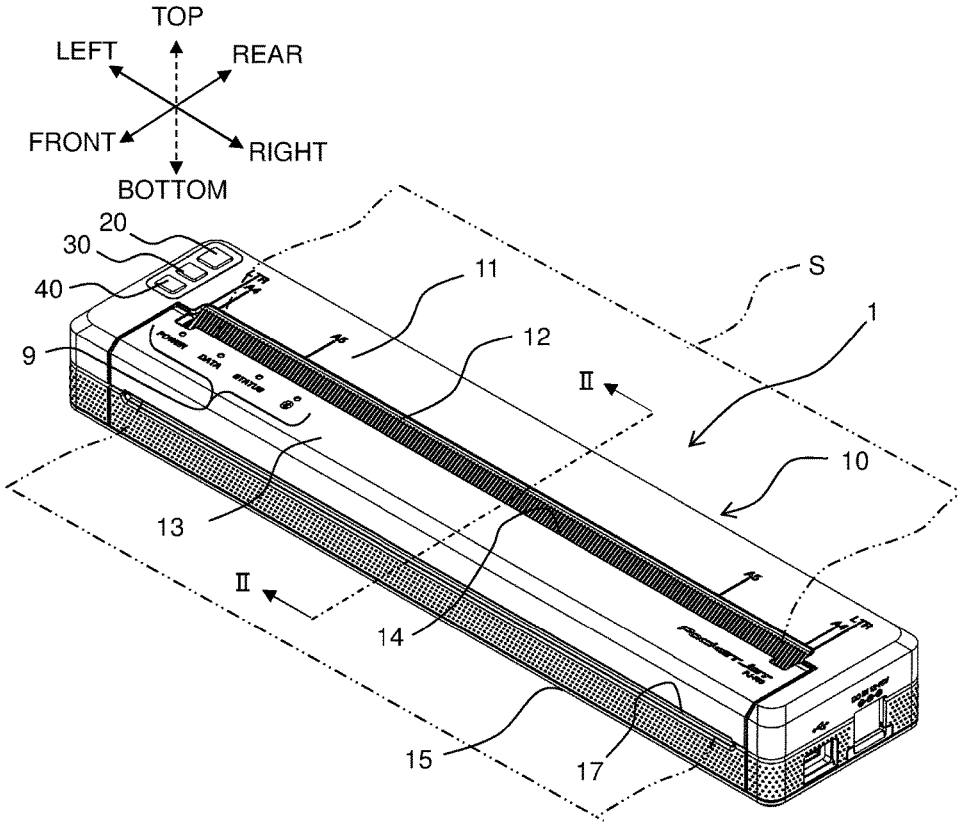
[FIG. 2]
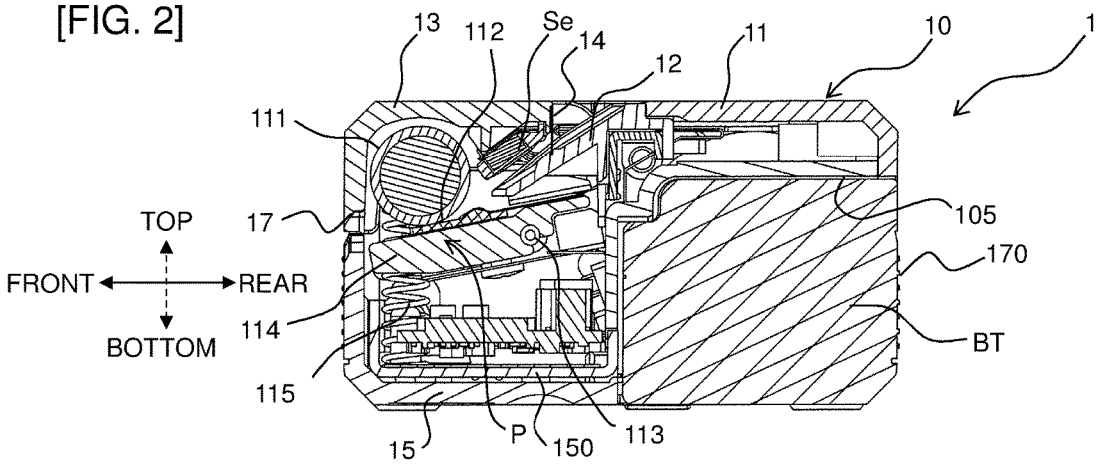

[FIG. 3]
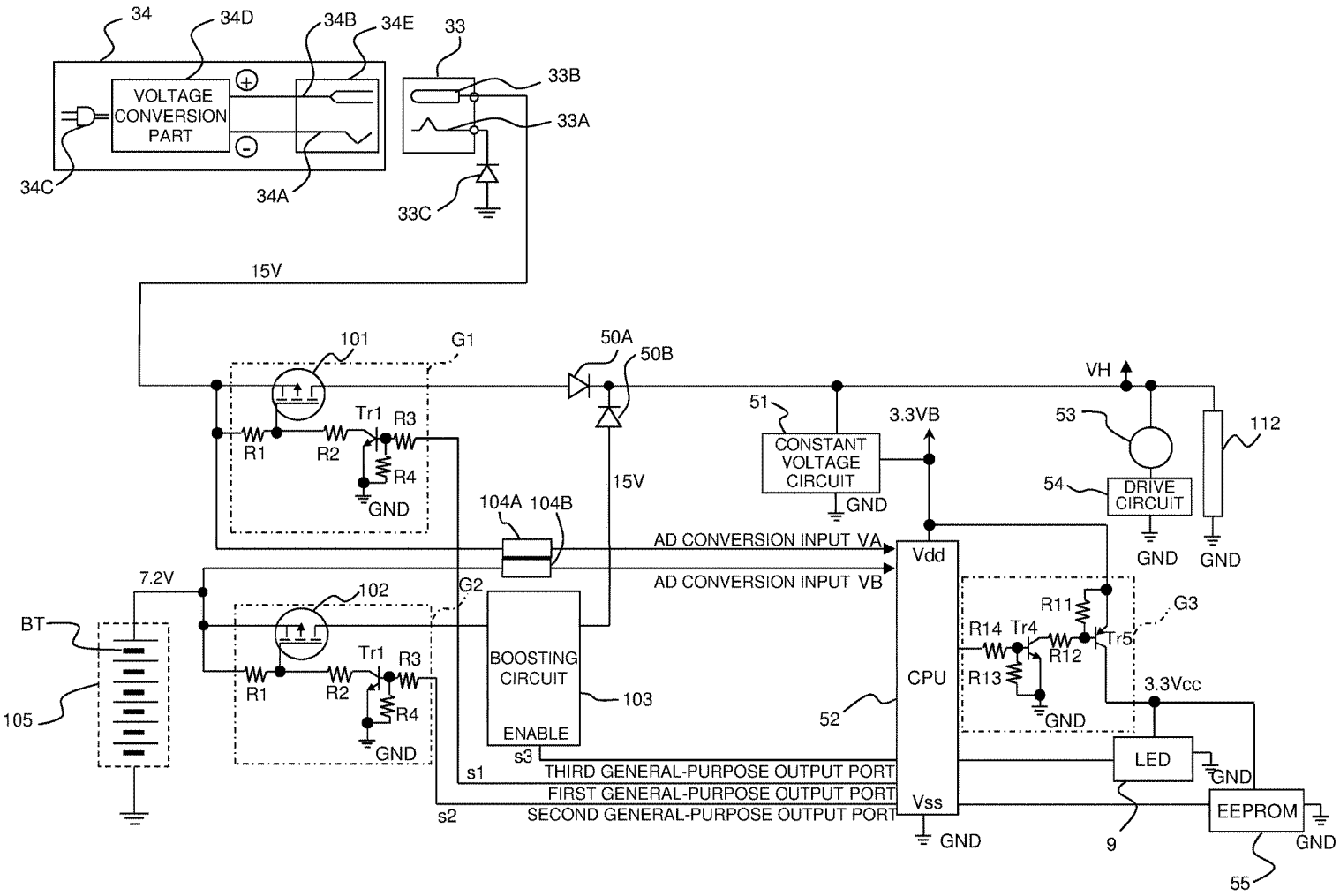

[FIG. 4]

| | S1 | S2 | S3 |
|---|---|---|---|
| NORMAL PRINTING MODE (EXTERNAL POWER SOURCE) | H | L | L |
| HIGH-SPEED PRINTING MODE (BATTERY) | L | H | H |

[FIG. 5]
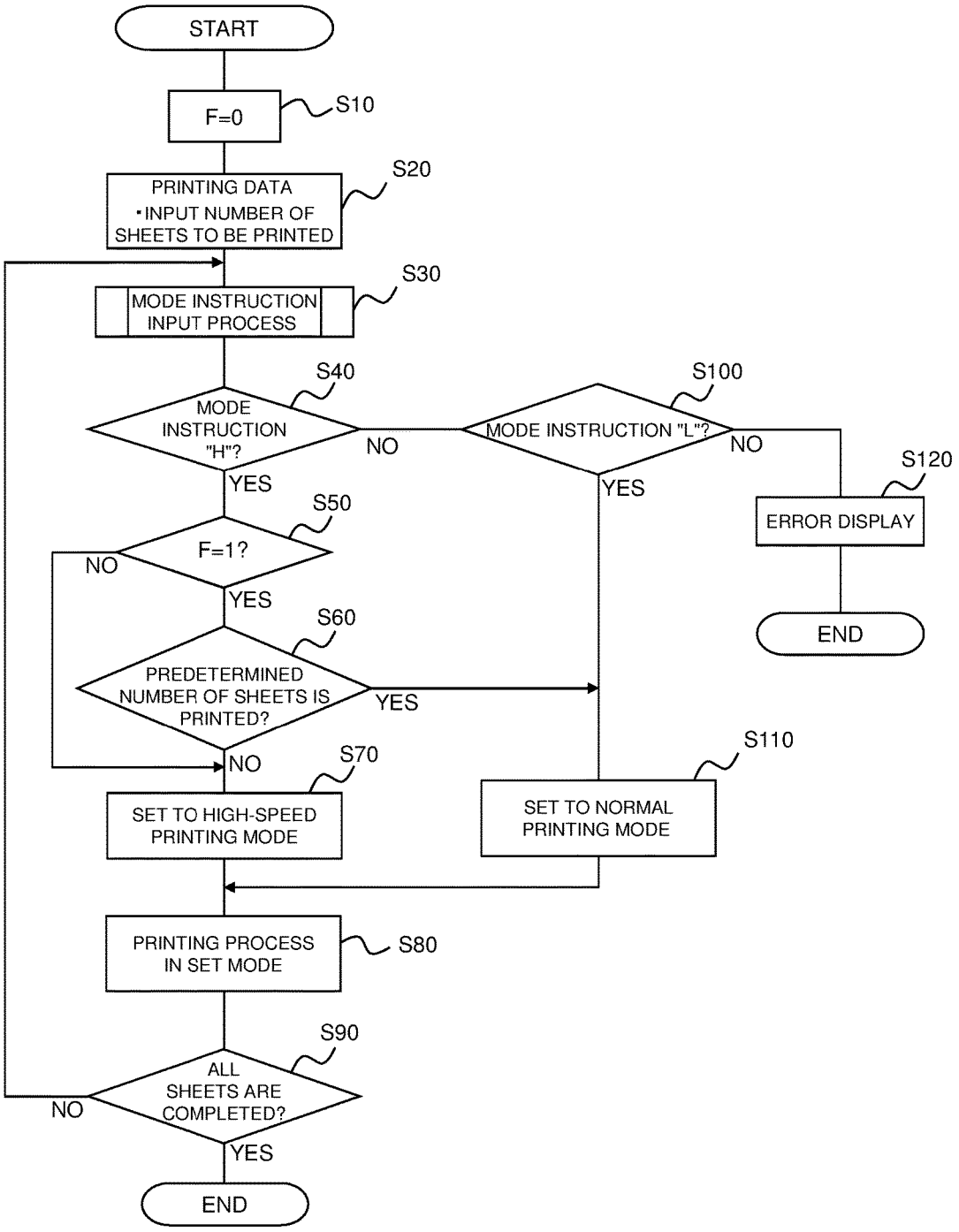

[FIG. 6]
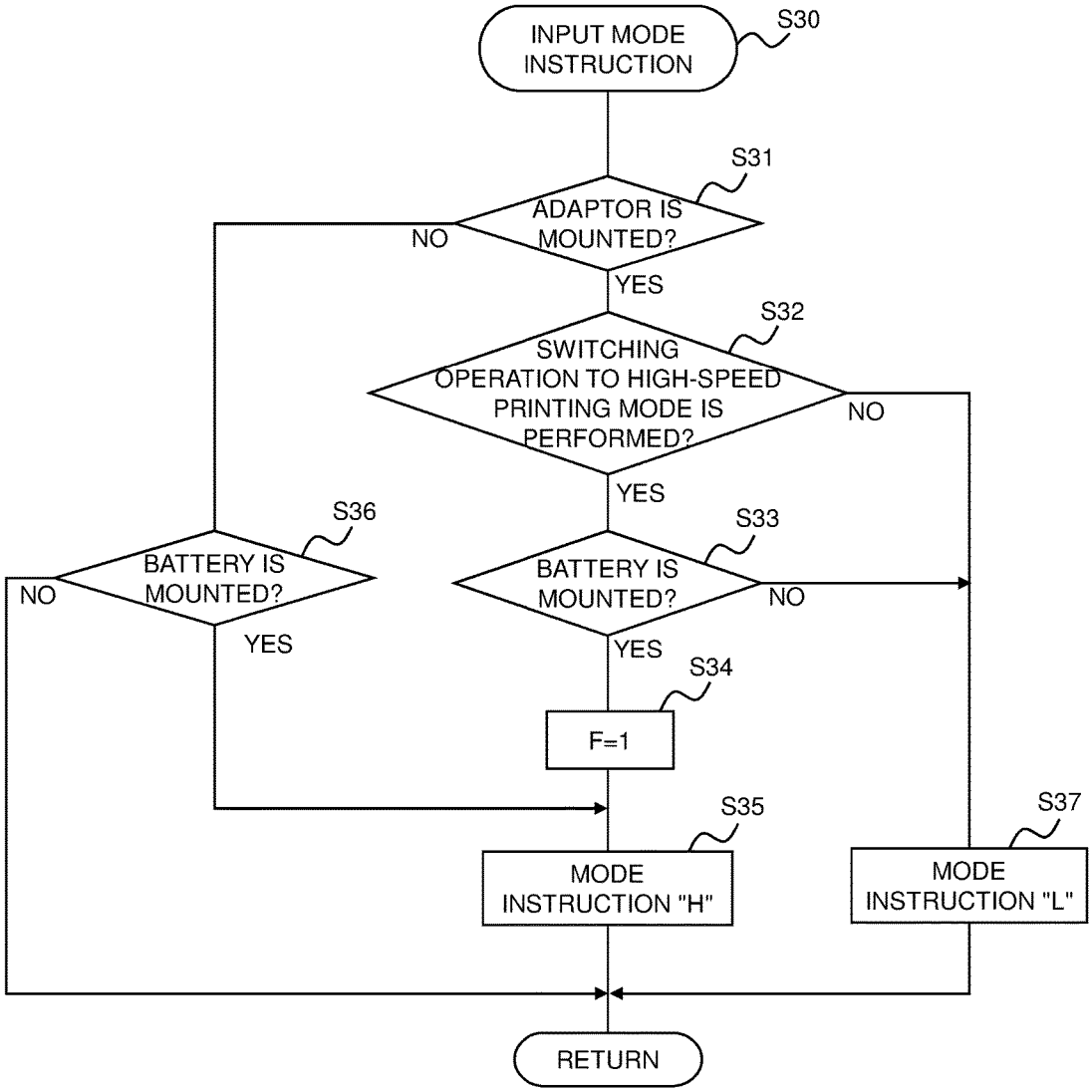

[FIG. 7]
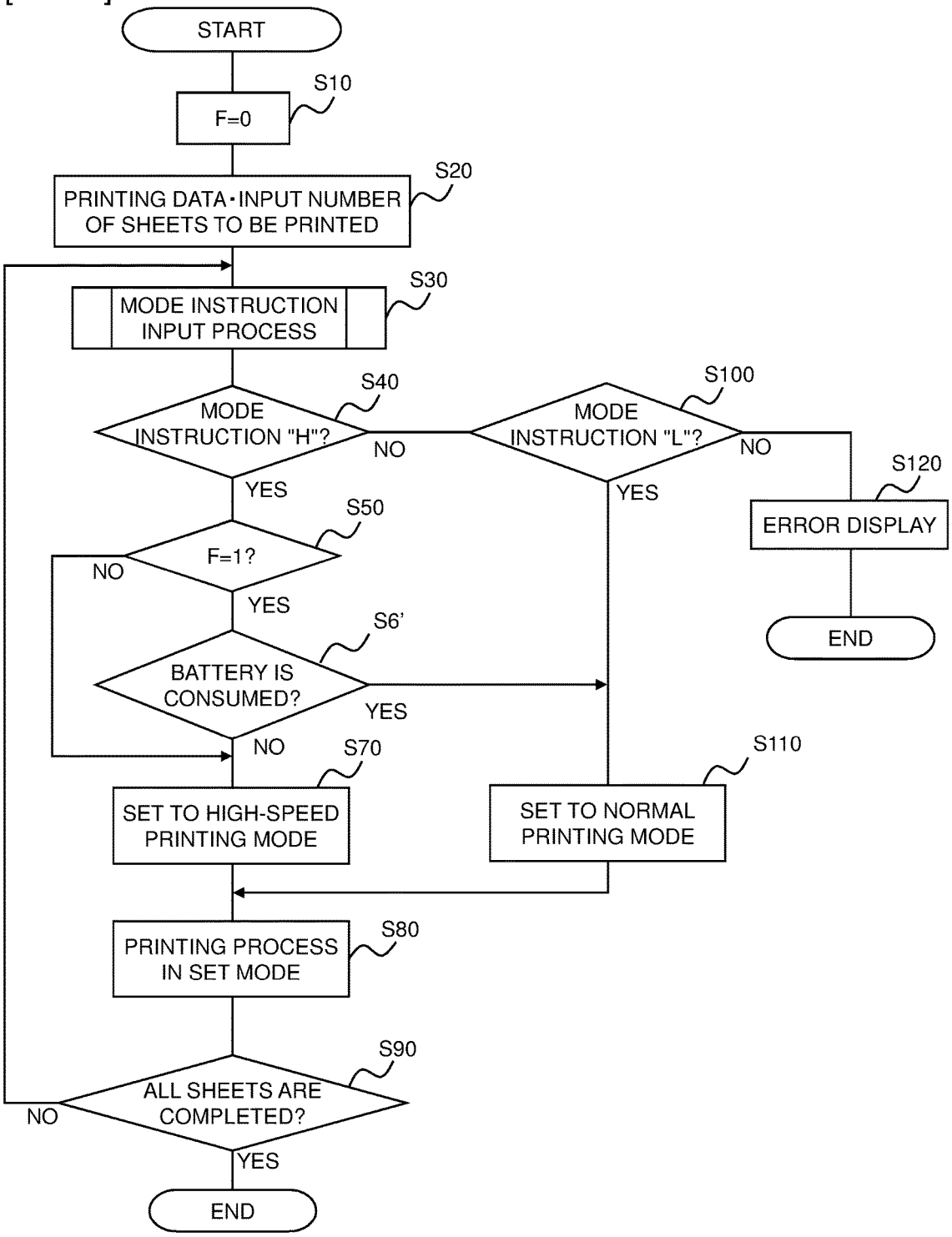

PRINTER

CROSS-REFERENCE TO RELATED APPLICATION

The present application claims priority from Japanese Patent Application No. 2015-185807, which was filed on Sep. 18, 2015, the disclosure of which is incorporated herein by reference in its entirety.

BACKGROUND

Field

The present disclosure relates to a printer performing printing on a print-receiving medium.

Description of the Related Art

A printer is already known that can be supplied with power from both an external power source device through an AC adapter and a battery.

However, in the prior art, when an AC adapter is mounted, the power supply from a battery is automatically switched to the power supply from an external power source device through the AC adapter. When the AC adapter is removed, the power supply from the external power source device through the AC adapter is automatically switched to the power supply from the battery. Since the power supply from the battery and the power supply from the external power source device through the AC adapter are not independently controlled, this is not necessarily sufficient from the viewpoint of convenience for an operator.

SUMMARY

It is therefore an object of the present disclosure to provide a printer enabling independent control of the power supply from a battery and the power supply from an external power source device so that the convenience for an operator can be improved.

In order to achieve the above described object, according to an aspect of the present application, there is provided a printer comprising a plurality of motion mechanisms including a feeder configured to feed a print-receiving medium and a printing head configured to form a desired print on the print-receiving medium fed by the feeder, a load circuit included in at least one of the plurality of motion mechanisms, a controller that is configured to control voltage supply to the load circuit, and is connected to an input part configured to be supplied with a power source voltage, a power receiving terminal configured to be connected to a power feeding terminal of an external power source device configured to supply a voltage, a first switching circuit that includes a first switch element configured to switch between conduction and interruption in accordance with a first control signal input from the controller, and is connected between the power receiving terminal and the input part, a battery storage part configured to store at least a battery is stored, and a second switching circuit that includes a second switch element configured to switch between conduction and interruption in accordance with a second control signal input from the controller, and is connected between the battery storage part and the input part.

The printer of the present disclosure enables both the power supply from the external power source device and the power supply from the battery stored in the battery storage part to the load circuit included in the motion mechanisms such as a feeder and a printing head.

These two power supply paths are respectively provided with the first switching circuit and the second switching circuit. In particular, the first switching circuit is disposed between the power receiving terminal connected to the power feeding terminal of the external power source device and the input part of the control circuit controlling the voltage supply to the load circuit. Similarly, the second switching circuit is disposed between the battery storage part in which the battery is stored and the input part of the control circuit.

The first switching circuit includes the first switch element, and the first switch element can switch between conduction and interruption in accordance with the first control signal input from a controller. Similarly, the second switching circuit includes the second switch element, and the second switch element can switch between conduction and interruption in accordance with the second control signal input from the controller.

As a result, the power supply from the battery and the power supply from the external power source device can independently be controlled. For example, while the external power source device is connected and the battery is housed in the battery storage part, priority is given to the power feeding from the external power source device and, if an instruction is subsequently given for performing high-speed printing (or if the power feeding terminal of the external power source device is pulled out), switching can be performed to give priority to the power feeding from the battery in the battery storage part. As a result, the convenience for an operator can be improved.

BRIEF DESCRIPTION OF THE DRAWINGS

FIG. 1 is a perspective view showing an appearance configuration of a portable printer of an embodiment of the present disclosure.

FIG. 2 is a side cross-sectional view showing an internal structure of the portable printer taken along a cross section II-II of FIG. 1.

FIG. 3 is a circuit diagram showing an electric configuration of an AC adapter and the portable printer.

FIG. 4 is a table showing forms of first to third control signals during execution of two printing modes.

FIG. 5 is a flowchart showing control procedures executed by a CPU.

FIG. 6 is a flowchart showing detailed procedures of step S30.

FIG. 7 is a flowchart showing control procedures executed by the CPU in a modification example of returning to a normal printing mode in accordance with a battery consumption degree.

DETAILED DESCRIPTION OF THE PREFERRED EMBODIMENTS

An embodiment of the present disclosure will now be described with reference to the drawings. This embodiment is an embodiment when the present disclosure is applied to a portable printer serving as a printer.

An appearance configuration and an internal structure of a portable printer 1 of this embodiment will be described with reference to FIGS. 1 and 2. In the following description, directions toward the lower left side, the upper left side, the upper left side, and the upper right side of FIG. 1 are forward, backward, leftward, and rightward, respectively. In the following description, the front, rear, left, right, upper, and lower directions stated with respect to each component correspond to the respective directions in the state of the component attached to the portable printer 1.

Overall Configuration

In FIGS. 1 and 2, the portable printer 1 prints print data received from, for example, an external device (not shown) such as a PC terminal and a portable telephone through wire communication or wireless communication onto various print-receiving mediums S. This portable printer 1 is generally constructed by assembling a substantially rectangular parallelepiped housing 10 forming a device outer contour made of a resin material and a chassis assembly (not shown).

The housing 10 includes a top cover 11 forming an upper portion of the device outer contour, a bottom cover 15 forming a lower portion of the device outer contour, and an openable cover member 13 disposed on the front side of an upper surface of the top cover 11.

The housing 10 has a platen roller 111 and a thermal line head 112 disposed therein. The thermal line head 112 is disposed on a radiator plate 114 including a shaft member 113 at an end part on the rear side, and the radiator plate 114 is rotatably supported around the shaft member 113 by side chassis members (not shown). A main chassis member 150 disposed on an inner surface of the bottom cover 15 is provided with a plurality of coil springs 115 rotationally urging the radiator plate 114 supporting the thermal line head 112 toward the platen roller 111. As a result, the thermal line head 112 can be pressed against the platen roller 111.

A battery storage part 105 storing battery units BT including batteries (not shown) is disposed on the rear side of the housing 10, and a battery chamber cover 170 is detachably disposed on the battery storage part 105. While the battery chamber cover 170 is removed, the battery storage part 105 opens in a rear surface portion of housing 100.

The chassis assembly (not shown) includes the main chassis member 150 disposed on the inner surface of the bottom cover 15 and making up a bottom part of the chassis assembly (not shown), and a pair of the side chassis members (not shown) vertically extending from both side end parts in the longitudinal direction of the main chassis member 150. The side chassis members have shaft holes (not shown) allowing the insertion of a shaft member (not shown) of the platen roller 111 so as to rotatably support the platen roller 111. The platen roller 111 is rotationally driven by a drive motor 53 (see FIG. 3 described later) to feed a print-receiving medium S. The side chassis members rotatably support the radiator plate 114 including the thermal line head 112 via the shaft member 113 described above.

The chassis member on the left side is provided with the drive motor 53 driving the platen roller 111 and a gear mechanism (not shown) made up of a plurality of gears transmitting a drive force of the drive motor 53 to the shaft member of the platen roller 111.

A beam member (not shown) is stretched between upper portions of the side chassis members and fixed by screws. A guide member 12 guiding the print-receiving medium S inserted into the insertion port 14 to a pressing part P between the platen roller 111 and the thermal line head 112 is formed as a separate member separated from the top cover 11, the bottom cover 15, and the cover member 13 making up the housing 10 and is disposed on the side chassis members by being fixed to the beam member. The insertion port 14 is formed into a substantially slit-like shape by a gab leading to the pressing part P between the guide member 12 and the cover member 13 and has a size capable of accommodating the maximum width size of the print-receiving medium S.

The guide member 12 has an upper part provided with a horizontal surface substantially horizontal when being assembled to the chassis assembly (not shown) and a slope inclined from the horizontal surface toward the inside of the device. On the horizontal surface and the slope, a plurality of rib parts formed along the guiding direction of the print-receiving medium S is arranged in parallel in the longitudinal direction.

<General Operation>

In the configuration, at the time of printing, the print-receiving medium S is inserted into the insertion port 14 formed between the top cover 11 and the cover member 13 with the cover member 13 closed. The inserted print-receiving medium S is guided by the guide member 12 disposed under the insertion port 14 to the pressing part P between the platen roller 111 and the thermal line head 112. The platen roller 111 comes into contact with the print-receiving medium S at a predetermined pressing force to feed the print-receiving medium S. The thermal line head 112 performs desired printing onto the fed print-receiving medium S. After completion of the printing, the print-receiving medium S is discharged from a discharge port 17 formed between the cover member 13 and the bottom cover 15. A sheet detection sensor Se is disposed on a feeding path to the discharge port 17 of the print-receiving medium S (e.g., near the insertion port 14). Based on a detection result of the sheet detection sensor Se, the feed by the platen roller 111 and the printing by the thermal line head 112 are controlled. In the case of jamming of paper etc., the cover member 13 is opened to release the platen roller 111 from the thermal line head 112 so that the print-receiving medium S can easily be pulled out.

On the left side of the top cover 11, the upper part of the housing 10 includes a feed key 20 for performing a sheet feeding operation, a power key 30 for performing a power on/off operation, and a mode switching button 40 for switching a mode of printing speed described later in this order from the rear side (the mode may be switched from a personal computer etc. connected separately).

<Circuit Configuration>

A circuit configuration of the portable printer 1 characterizing this embodiment will be described with reference to FIG. 3. As shown in FIG. 3, the portable printer 1 of this embodiment can be supplied with power from both the an AC adapter 34 making up a portion of an external power source device (it is noted that the AC adapter 34 is removed from the portable printer 1 in the state shown in FIG. 3) and the batteries BT stored in the battery storage part 105.

<Circuit Overview>

In particular, the portable printer 1 is provided with the battery storage part 105 storing a plurality of (in this example, six) batteries BT, a first switching circuit G1, a second switching circuit G2, a third switching circuit G3, a constant voltage circuit (linear regulator) 51 capable of outputting a constant voltage (in this example, 3.3 VB), a CPU 52 made up of a microcomputer etc., and performing predetermined calculations, a drive motor 53 including a coil, a drive circuit 54 connected to the drive motor 53, the thermal line head 112 including a plurality of heat generation elements (not shown), LEDs 9 made up of a plurality of light-emitting diodes connected to the CPU 52, and an EEPROM 55 connected to the CPU 52 and capable of storing data.

<Battery Storage Part>

In the battery storage part 105, the batteries BT are stored in series. A series of these six batteries BT is grounded on the cathode side. The anode side of the series of these six batteries BT is connected to the second switching circuit G2 including a second switching element 102.

<AC Adapter>

On the other hand, the AC adapter 34 for the power supply from the external power source device has an AC plug 34C connected to an AC outlet (not shown) side of the external power source device capable of supplying a voltage, a voltage conversion part 34D connected to the AC plug 34C, and a DC plug 34E connected to the voltage conversion part 34D and supplied with a predetermined voltage (in this example, 15 V). A DC plug 34E has a first terminal 34A on the negative side and a second terminal 34B on the positive side.

<DC Jack>

Accordingly, the portable printer 1 includes a DC jack 33 to which the DC plug 34E can be connected. The DC jack 33 includes a first terminal 33A on the negative side that is to be connected with the first terminal 34A of the DC plug 34E and that is connected to a negative-side bus line, and a second terminal 33B on the positive side that is to be connected with the second terminal 34B of the DC plug 34E and that is connected to a positive-side bus line. The first terminal 33A is grounded via a back flow preventing diode 33C, and the second terminal 33B is connected to the first switching circuit G1.

<First Switching Circuit>

The first switching circuit G1 is made up of a P-channel MOSFET 101 switching between conduction and interruption in accordance with a first control signal 51 input from the CPU 52, an NPN transistor Tr1, and resistors R1, R2, R3, R4.

The source side of the first switch element 101 is connected to the second terminal 33B of the DC jack 33.

The drain side of the first switch element 101 is connected via the back flow preventing diode 50A to a power source line VH having the constant voltage circuit 51, the drive motor 53, and the thermal line head 112 serving as loads.

The source side of the first switch element 101 is also connected via the resistor R1 to the gate side of the first switch element 101. The gate side of the first switch element 101 is connected via the resistor R2 to the collector side of the transistor Tr1. The emitter side of the transistor Tr1 is grounded, and the resistor R4 is disposed to connect the base side and the emitter side (ground side) of the transistor Tr1. The base side of the transistor Tr1 is connected via the resistor R3 to a first general-purpose output port of the CPU 52 to form a path of the first control signal S1.

The source side of the first switch element 101 is connected via a voltage-dividing circuit 104A to an AD conversion input port of the CPU 52, and a detection voltage VA (adapter voltage) is input to the CPU 52.

<Second Switching Circuit G2>

The second switching circuit G2 has a configuration equivalent to the first switching circuit G1 and is made up of a P-channel MOSFET 102 switching between conduction and interruption in accordance with a second control signal S2 input from the CPU 52, an NPN transistor Tr1, and resistors R1, R2, R3, R4.

The source side of the second switch element 102 is connected to the anode side of the batteries BT. The drain side of the second switch element 102 is connected to a boosting circuit 103.

As is the case with the first switch element 101, the source side of the second switch element 102 is also connected via the resistor R1 to the gate side of the second switch element 102 and is further connected via the resistor R2 to the collector side of the transistor Tr. The emitter side of the transistor Tr1 is grounded, and the resistor R4 is disposed to connect the base side and the emitter side (ground side). The base side of the transistor Tr1 is connected via the resistor R3 to the second general-purpose output port of the CPU 52 to form a path of the second control signal S2.

The source side of the second switch element 102 is connected via a voltage-dividing circuit 104B to the AD conversion input port of the CPU 52, and a detection voltage VB (battery voltage) is input to the CPU 52.

<Boosting Circuit>

The boosting circuit 103 boosts a terminal voltage from the batteries BT stored in the battery storage part 105 to a predetermined voltage (in this example, 15 V). The load side of the boosting circuit 103 is connected via a back flow preventing diode 50B to the power source line VH. As a result, the load side of the first switching circuit G1 and the load side of the boosting circuit 103 electrically form OR connection via the back flow preventing diodes 50A, 50B and are connected to the power source line VH.

<Operations of First Switching Circuit G1, Second Switching Circuit G2, Boosting Circuit>

The operations of the first switching circuit G1 and the second switching circuit G2 having the above configuration will be described. In this embodiment, a threshold value related to the gate voltage of the first switch element 101 and the second switch element 102 is set to, for example, 1.0 [V] (or −1.0 [V]) and, if a gate voltage VGS (a gate voltage from the viewpoint of the source side of the first and second switch elements 101, 102) exceeds this voltage, the first switch element 101 and the second switch element 102 are made conductive. In this embodiment, the P-channel first and second switch elements 101, 102 are switched by a high-level signal H or a low-level signal L from the first and second general-purpose output ports of the CPU 52 so as to switch conduction and interruption of the first switching circuit G1 and the second switching circuit G2.

In particular, when the first control signal S1 from a first general-purpose output port of the CPU 52 is the high-level signal H, the transistor Tr1 is put into the ON state in the first switching circuit G1. As a result, the gate voltage VGS of the first switch element 101 has a value (e.g., −1.6 [V]) exceeding the threshold value of −1.0 [V] and the first switch element 101 is made conductive. On the other hand, when the first control signal S1 from the first general-purpose output port of the CPU 52 is the low-level signal L, the transistor Tr1 is put into the OFF state in the first switching circuit G1, and the gate voltage VGS of the first switch element 101 is set to 0[V], which makes the first switch element 101 non-conductive.

Similarly in the second switching circuit G2, when the second control signal S2 from a second general-purpose output port of the CPU 52 is the high-level signal H, the transistor Tr1 is put into the ON state. As a result, the gate voltage VGS of the second switch element 102 has a value (e.g., −1.6[V]) exceeding the threshold value of −1.0 [V] and the second switch element 102 is made conductive. On the other hand, when the first control signal S2 form the second general-purpose output port of the CPU 52 is the low-level signal L, the transistor Tr1 is put into the OFF state in the second switching circuit G2, and the gate voltage VGS of the second switch element 102 is set to 0[V], which makes the second switch element 102 non-conductive.

Additionally, the boosting circuit 103 includes a boost switching terminal (enable input) for switching between direct conduction and boosted conduction. When the third control signal S3 from a third general-purpose output port of the CPU 52 is the high-level signal H, the boosting circuit 103 is switched to a boosted conduction state so that the terminal voltage from the batteries BT is boosted to 15 V described above and supplied toward the back flow preventing diode 50B. When the third control signal S3 from the third general-purpose output port of the CPU 52 is the low-level signal L, the boosting circuit 103 is switched to a direct conduction state so that the terminal voltage from the batteries BT is supplied directly (without boosting) toward the back flow preventing diode 50B.

<Third Switching Circuit G3>

The third switching circuit G3 is a circuit switching ON/OFF of a Vcc power source and includes transistors Tr4, Tr5 and resistors R11-R14. The base side of the transistor Tr4 is connected via the resistor R14 to the CPU 52, and the resistor R13 is disposed to connect the base side and the emitter side (ground side) of the transistor Tr4. The collector side of the transistor Tr4 is connected via the resistor R12 to the base side of the transistor Tr5, and the emitter side of the transistor Tr5 is connected to a Vdd terminal of the CPU 52. The emitter side and the base side of the transistor Tr5 are connected via the resistor R11, and the collector side of the transistor Tr5 acts as an output end of a predetermined voltage (3.3 Vcc) and is connected to the LEDs 9 and the EEPROM 55.

In the third switching circuit G3 having the above configuration, an ON/OFF control signal from the CPU 52 switches the transistor Tr2 and the transistor Tr1 to ON or OFF, thereby controlling the power feeding to the LEDs 9 and the EEPROM 55.

<Switching of Two Modes>

As described above, in the portable printer 1 of this embodiment, the first switching circuit G1 includes the first switch element 101, and the first switch element 101 can switch between conduction and interruption in accordance with the first control signal S1 input from the outside. Similarly, the second switching circuit G2 includes the second switch element 102, and the second switch element 102 can switch between conduction and interruption in accordance with the second control signal S2 input from the outside. The AC adapter 34 includes a current limiting circuit in consideration of the safety at the time of a short circuit. On the other hand, rechargeable batteries with a large allowable output current are used for the batteries BT. Therefore, the portable printer 1 can perform printing while switching two modes, i.e., a normal printing mode of printing at a (predefined) normal printing speed with larger power from the external power source device through the AC adapter 34 and a high-speed mode of printing at a printing speed higher than the normal printing speed with power from the batteries BT. This mode switching is executed by the CPU 52 outputting the first to third control signal S1-S3 in accordance with an operation of the mode switching button 40 described above and an input of a corresponding operation signal to the CPU 52 (or in accordance with an operation signal input to the CPU 52 due to an operation etc. from an external personal computer (PC)), for example.

<Normal Printing Mode>

In particular, as shown in FIG. 4, during execution of the normal printing mode, the first control signal S1 output by the CPU 52 is set to the high-level signal H to make the first switch element 101 of the first switching circuit G1 conductive, while the second control signal S2 is set to the low-level signal L to interrupt the second switch element 102 of the second switching circuit G2, and the third control signal S3 is set to the low-level signal L to put the boosting circuit 103 into the direct conduction state. As a result, the voltage of 15 V supplied from the external power source device and converted by the voltage conversion part 34D of the AC adapter 34 is supplied through the DC jack 33, the first switching circuit G1, and the back flow preventing diode 50A to the constant voltage circuit 51, the drive motor 53, the thermal line head 112, etc., and the printing is performed in the normal printing mode. In this embodiment, if the AC adapter 34 is mounted, the CPU 52 preferentially executes the normal printing mode in principle regardless of whether the batteries BT are stored in the battery storage part 105 (with exceptions such as when the button 40 is operated to give an instruction for switching to a high-speed printing mode).

<High-Speed Printing Mode>

During execution of the high-speed printing mode, the first control signal S1 output by the CPU 52 is set to the low-level signal L to interrupt the first switch element 101 of the first switching circuit G1, while the second control signal S2 is set to the high-level signal H to make the second switch element 102 of the second switching circuit G2 conductive, and the third control signal S3 is set to the high-level signal H to put the boosting circuit 103 into the boosted conduction state. As a result, the voltage of 7.2 V supplied from the batteries BT of the battery storage part 105 is sent through the second switching circuit G2 and boosted to 15V by the boosting circuit 103 and is then supplied through the back flow preventing diode 50B to the constant voltage circuit 51, the drive motor 53, the thermal line head 112, etc., and the printing is performed in the high-speed printing mode. In the embodiment, if the AC adapter 34 is not mounted and the batteries BT are stored in the battery storage part 105, the CPU 52 always executes the high-speed printing mode.

<Automatic Return from High-Speed Printing Mode to Normal Printing Mode>

Additionally, in this embodiment, not only are the two printing modes simply selectively switched as described above, but also the printing mode may be returned to the normal printing mode when print formation is completed for a predetermined unit amount of the print-receiving mediums S (in this example, a predetermined number of sheets to be printed. for example, one or several A4 sheets) after switching from the normal printing mode to the high-speed printing mode (triggered by input of the operation signal described above), for example.

<Control Procedures>

Control procedures executed by the CPU 52 for performing an automatic return function from the high-speed printing mode to the normal printing mode will be described with reference to FIGS. 5 and 6.

In a flow shown in FIG. 5, first, at step S10, the CPU 52 initializes a high-speed printing mode switching flag F=0 and goes to step S20.

At step S20, the CPU 52 inputs the print data for printing on the print-receiving mediums S and the number of the print-receiving mediums S to be printed in accordance with, for example, an operation of an appropriate operation part of the portable printer 1 (or an appropriate input operation on an external personal computer).

Subsequently, at step S30, the CPU 52 executes a mode instruction input process of inputting an execution instruction for selectively executing the normal printing mode or the high-speed printing mode.

Detailed procedures of the mode instruction input process of step S30 will be described with reference to FIG. 6. In FIG. 6, first, at step S31, the CPU 52 determines whether the AC adapter 34 is mounted on (connected to) the DC jack 33 of the portable printer 1, with a known appropriate technique. If not mounted, the determination of step S31 is negative (S31:NO) and the CPU 52 goes to step S36 described later. If mounted, the determination of step S31 is affirmative (S31:YES) and the CPU 52 goes to step S32.

At step S32, the CPU 52 determines whether an operator performs a switching instruction operation for the high-speed printing mode through the mode switching button 40, for example. If the switching instruction operation is not performed, the determination of step S32 is negative (S32:NO) and the CPU 52 goes to step S37 described later. If the instruction operation for switching is performed, the determination of step S32 is affirmative (S32:YES) and the CPU 52 goes to step S33.

At step S33, the CPU 52 determines whether the batteries BT are mounted on the battery storage part 105, with a known appropriate technique. If the batteries BT are not mounted, the determination of step S33 is negative (S33:NO) and the CPU 52 goes to step S37 described later. If the batteries BT are mounted, the determination of step S33 is affirmative (S33:YES) and the CPU 52 goes to step S34.

At step S34, in accordance with the fact that (although the normal printing mode is normally executed without change because the AC adapter 34 is mounted) the instruction for the high-speed printing mode is given due to the intention of the operator (see step S32 described above), the CPU 52 sets the high-speed printing mode switching flag to F=1 and goes to step S35.

At step S35, the CPU 52 sets a mode instruction to "H" corresponding to the high-speed printing mode. Subsequently, the CPU 52 goes to step S40 of FIG. 5 described later.

On the other hand, at step S36 after the negative determination of step S31, as is the case with step S33, the CPU 52 determines whether the batteries are mounted on the battery storage part 105, with a known method. If the batteries are not mounted, the determination of step S36 is negative (S36:NO) and the CPU 52 directly goes to step S40 of FIG. 5. If the batteries are mounted, the determination of step S36 is affirmative (S36:YES) and the CPU 52 goes to step S35 to set the mode instruction to "H." Subsequently, the CPU 52 goes to step S40 of FIG. 5.

On the other hand, at step S37 after the negative determination of step S32 or step S33, in accordance with the fact that no particular instruction is given by the operator for switching to the high-speed printing mode while the AC adapter 34 is mounted or that, although the instruction is given for the switching, the batteries BT are not stored in the battery storage part 105, the CPU 52 sets the mode instruction to "L" corresponding to the normal printing mode. Subsequently, the CPU 52 goes to step S40 of FIG. 5 described later.

Returning to FIG. 5, after step S30 is completed as described above, the CPU 52 goes to step S40. At step S40, the CPU 52 determines whether the mode instruction is "H" at step S30. If the mode instruction is "L," the determination of step S40 is negative (S40:NO) and the CPU 52 goes to step S100 described later. If the mode instruction is "H," the determination of step S40 is affirmative (S40:YES) and the CPU 52 goes to step S50.

At step S50, the CPU 52 determines whether the high-speed printing mode switching flag F is 1. If F=0, the determination of step S50 is negative (S50:NO) and the CPU 52 goes to step S70 described later. On the other hand, if the F=1 is set because the operator intentionally gives an instruction for the high-speed printing mode while the AC adapter 34 is mounted as described above (see step S34), the determination of step S50 is affirmative (S50:YES) and the CPU 52 goes to step S60.

At step S60, the CPU 52 determines whether the printing of the predetermined number (predetermined unit amount) of the sheets S to be printed is completed. If the printing of the predetermined number of the sheets is completed after the operator intentionally gives the instruction for switching to the high-speed mode as described above, the determination of step S60 is affirmative (S60:YES and the CPU 52 goes to step S110 described later. If the printing of the predetermined number of the sheets is not completed, the determination of step S60 is negative (S60:NO) and the CPU 52 goes to step S70.

At step S70, the CPU 52 sets the printing mode to the high-speed printing mode. In particular, the CPU 52 outputs the low-level signal L as the first control signal S1 to the first switching circuit G1 and outputs the high-level signal H as the second control signal S2 to the second switching circuit G2. As a result, the first switching circuit G1 is made non-conductive, and the second switching circuit G2 is made conductive. Additionally, the CPU 52 outputs the high-level signal H as the third control signal S3 to the boosting circuit 103 and, as a result, the boosting circuit 103 is put into the boosted conduction state. Consequently, the power feeding from the external power source device capable of voltage supply through connection of the AC adapter 34 is interrupted, and the power from the batteries in the battery storage part 105 is boosted and supplied to the constant voltage circuit 51, the drive motor 53, the thermal line head 112, etc. Subsequently, the CPU 52 goes to step S80 described later.

On the other hand, at step S100 after the negative determination of step S40, the CPU 52 determines whether the mode instruction is "L." If the mode instruction is not "L," the determination of step S100 is negative (S100:NO) and the CPU 52 goes to step S120 for error display by the LEDs 9 (e.g., by making the third switching circuit G3 conductive) and then terminates this flow.

If the mode instruction is "L," the determination of step S100 is affirmative (S100:YES) and the CPU 52 goes to step S110. As described above, if the determination of step S60 is affirmative (if the printing of the predetermined number of sheets is completed after the operator intentionally gives the instruction for switching to the high-speed mode), the CPU 52 also goes to step S110. At step S110, the CPU 52 sets the printing mode to the normal printing mode. In particular, the CPU 52 outputs the high-level signal H as the first control signal S1 to the first switching circuit G1 and outputs the low-level signal L as the second control signal S2 to the second switching circuit G2. As a result, the first switching circuit G1 is made conductive and the second switching circuit G2 is made non-conductive. Additionally, the CPU 52 outputs the low-level signal L as the third control signal S3 to the boosting circuit 103 and, as a result, the boosting circuit 103 is put into the direct conduction state. Consequently, the power feeding from the batteries BT in the battery storage part 105 is interrupted, and the power from the external power source device is supplied through the AC adapter 34 to the constant voltage circuit 51, the drive motor 53, the thermal line head 112, etc. Subsequently, the CPU 52 goes to step S80.

At step S80, the CPU 52 performs a printing process of printing the print data input at step S20 onto the print-receiving medium S in the printing mode that has been set at this time point (the high-speed printing mode set at step S70 or the normal printing mode set at step S110).

Subsequently, at step S90, the CPU 52 determines whether the printing process of step S80 is completed for all the number of sheets input at step S20. If the printing of all the number of sheets is not yet completed, the determination of step S90 is negative (S90:NO) and the CPU 52 returns to step S30 to repeat the same procedure. If the printing of all the number of sheets is completed, the determination of step S90 is affirmative (S90:YES) and the CPU 52 terminates this flow.

By executing the flow described above, if the operator gives an instruction for shifting to the high-speed printing mode in the state of the normal printing mode (i.e., while the AC adapter 34 is mounted), the printing mode can subsequently automatically be returned to the normal printing mode, without performing a particular return instruction operation for the normal printing mode, after a predetermined unit amount of print formation (in this example, a predetermined number of sheets to be printed. alternatively, a predetermined print length or a predetermined print range area may be specified).

As described above, in the portable printer 1 of this embodiment, the first switching circuit G1 includes the first switch element 101 capable of switching between conduction and interruption in accordance with the first control signal S1, and the second switching circuit G2 includes the second switch element 102 capable of switching between conduction and interruption in accordance with the second control signal S2. As a result, the power supply from the batteries BT and the power supply from the external power source device (through the AC adapter 34) can independently be controlled. In particular, as described above, for example, while the AC adapter 34 is mounted and the batteries BT are stored in the battery storage part 105, priority is given to the power feeding from the external power source device through the AC adapter 34 and, if an instruction is subsequently given for executing the high-speed printing mode (or if the power feeding terminal of the external power source device is pulled out), switching can be performed to give priority to the power feeding from the batteries BT in the battery storage part 105. As a result, the convenience for an operator can be improved.

Particularly in this embodiment, the boosting circuit 103 for boosting the terminal voltage from the batteries BT is connected between the second switching circuit G2 and the constant voltage circuit 51. As a result, even if the batteries BT are consumed and the terminal voltage becomes lower, a voltage of a predetermined level (in the above example, 15V) can reliably be supplied to the load side.

In this regard, particularly in this embodiment, as described above, the printing modes can be switched and utilized between the normal printing mode of printing at the normal printing speed with the power supplied from the external power source device and the high-speed printing mode of printing at the high printing speed with the power supplied from the batteries BT. In this case, the CPU 52 outputs the first to third control signals S1-S3 so as to selectively execute the normal printing mode or the high-speed printing mode in accordance with the input operation signal. Consequently, these two printing modes can smoothly be switched.

Particularly in this embodiment, as described above with reference to the flows of FIGS. 5 and 6, after the operator performs an operation of giving an instruction for shifting to the high-speed printing mode in the state of the normal printing mode, the printing mode can automatically be returned to the the normal printing mode after the predetermined unit amount of print formation, without performing a particular return instruction operation for the normal printing mode. Particularly, since a large current is supplied from the batteries BT to the load side in the high-speed printing mode, the batteries BT can reliably be prevented from being heavily consumed because of accidentally forgetting to perform the return instructing operation.

The present disclosure is not limited to the embodiment and may variously be modified without departing from the spirit and the technical ideas thereof. Such modification examples will hereinafter be described in order.

(1) When Normal Printing Mode Is Automatically Returned in Accordance with Consumption Degree of Batteries Although the return from the high-speed printing mode to the normal printing mode is triggered by completion of the predetermined unit amount of printing in the embodiment, this is not a limitation, and the return from the high-speed printing mode to the normal printing mode may be triggered by reaching a certain level of consumption of the batteries BT.

FIG. 7 is a flowchart showing control procedures executed by the CPU 52 in this modification example. In the flow shown in FIG. 7, step S60' is provided instead of step S60 of FIG. 5. At step S60', the CPU 62 determines whether a consumption degree of the batteries reaches a predetermined threshold value defined in advance. In particular, as described above, to the AD conversion input port of the CPU 52, the terminal voltage of the batteries BT is input as the detection voltage VB to the CPU 52 (a function of the CPU 52). At step S60', based on the input detection voltage VB, a consumption degree of the batteries BT is determined in accordance with whether a voltage drop amount of the batteries BT stored in the battery storage part 105 reaches a predetermined value defined in advance. If the voltage drop amount reaches the predetermined value or more, the CPU 52 considers that a consumption degree of the batteries BT reaches the predetermined threshold value and, therefore, the determination of step S60' is affirmative (S60':Yes) and the CPU 52 goes to step S110 to return to the normal printing mode.

The flowchart is the same as FIG. 6 except step S60' and will not be described.

In this variation example, after the operator performs an operation of giving an instruction for shifting to the high-speed printing mode in the state of the normal printing mode, the printing mode is automatically returned to the normal printing mode when the batteries are consumed to some extent, without performing a particular return instruction operation for the normal printing mode. As a result, in the same way as above, the batteries can reliably be prevented from being accidentally heavily consumed.

(2) Other Variations of Switching

Although the first control signal S1, the second control signal S2, and the third control signal are all switched between the high-level signal H and the low-level signal L in the above description, this is not a limitation. In particular, if the switching control between the high-level signal H and the low-level signal L is carried out for the third control signal S3, the second control signal S2 may always be set to the high-level signal H (on the basis that the batteries BT are mounted). This is because the configuration shown in FIG. 3 has a so-called wired OR connection (a connection form in which a plurality of output signals is wired by using diodes) through the back flow preventing diodes 50A, 50B and the power is automatically supplied from the higher voltage side between the AC adapter 34 and the batteries BT.

Alternatively, the second control signal S2 may normally be set to the high-level signal H as described above and may be set to the low-level signal L when the output voltage (terminal voltage) of the batteries BT becomes less that a predetermined value (e.g., 4.2 [V]). This produces the effect that the degradation due to over discharge of the batteries BT can be prevented.

(3) Others

The arrows shown in FIG. 3 indicate an example of signal flow and are not intended to limit the signal flow directions.

The flowcharts shown in FIGS. 5, 6, and 7. are not intended to limit the present disclosure to the procedures shown in the flows and the procedures may be added/deleted or may be executed in different order without departing from the spirit and the technical ideas of the disclosure.

The techniques of the embodiment and the modification examples may appropriately be utilized in combination other than those described above.

What is claimed is:

1. A printer comprising:

a plurality of motion mechanisms including a feeder configured to feed a print-receiving medium and a printing head configured to form a desired print on said print-receiving medium fed by said feeder;

a load circuit included in at least one of said plurality of motion mechanisms;

a controller that is configured to control voltage supply to said load circuit, and is connected to an input part configured to be supplied with a power source voltage;

a power receiving terminal configured to be connected to a power feeding terminal of an external power source device configured to supply a voltage;

a first switching circuit that includes a first switch element configured to switch between conduction and interruption in accordance with a first control signal input from said controller, and is connected between said power receiving terminal and said input part;

a battery storage part configured to store at least a battery; and a second switching circuit that includes a second switch element configured to switch between conduction and interruption in accordance with a second control signal input from said controller, and is connected between said battery storage part and said input part.

2. The printer according to claim 1, further comprising a boosting circuit that is configured to boost a terminal voltage from said battery stored in said battery storage part, and includes a boost switching terminal for switching between direct conduction and boosted conduction by a third control signal input from said controller, and is connected between said second switching circuit and said input part.

3. The printer according to claim 2, further comprising:

a normal printing mode at a predefined normal printing speed with said first switch element in a conductive state; and a high-speed printing mode at a printing speed higher than said normal printing speed with said first switch element in an interrupted state, said second switch element in a conductive state, and said boosting circuit in a boosted conduction state.

4. The printer according to claim 3, wherein said controller is configured to selectively execute said normal printing mode or said high-speed printing mode in accordance with an input operation signal, by outputting said first to third control signals.

5. The printer according to claim 4, wherein said controller is configured to execute said normal printing mode by putting said first switch element into the conductive state by means of control of said first control signal, and to execute said high-speed printing mode by putting said first switch element into the interrupted state by means of control of said first control signal, putting said second switch element into the conductive state by means of control of said second control signal, and putting said boosting circuit into the boosted conduction state by means of control of said third control signal.

6. The printer according to claim 5, wherein connections between said first switching circuit and said input part and between said boosting circuit and said input part form a wired OR connection.

7. The printer according to claim 4, wherein said controller is configured to execute said normal printing mode by putting said first switch element into the conductive state by means of control of said first control signal, putting said second switch element into an interrupted state by means of control of said second control signal, and putting said boosting circuit into a direct conduction state by means of control of said third control signal, and to execute said high-speed printing mode by putting said first switch element into the interrupted state by means of control of said first control signal, putting said second switch element into the conductive state by means of control of said second control signal, and putting said boosting circuit into the boosted conduction state by means of control of said third control signal.

8. The printer according to claim 4, wherein said controller is configured to return to said normal printing mode when print formation is completed for a predetermined unit amount of said print-receiving mediums after switching to said high-speed printing mode triggered by said operation signal input in said normal printing mode.

9. The printer according to claim 4, further comprising a detection portion configured to detect a consumption degree of said battery stored in said battery storage part, wherein said controller is configured to return to said normal printing mode when the consumption degree of said battery detected by said detection portion reaches a predetermined threshold value after switching to said high-speed printing mode triggered by said operation signal input in said normal printing mode.

10. The printer according to claim 4, further comprising a mode switching button, wherein said printer is configured to input said operation signal by said mode switching button being pressed.

11. The printer according to claim 4, wherein said controller is configured to:

determine whether said power feeding terminal of said external power source device is connected to said power receiving terminal, determine whether said operation signal is input, in the case that it is determined that said power feeding terminal is connected, and determine whether said battery is mounted on said battery storage part, in the case that it is determined that said operation signal is input, and execute said high-speed printing mode, in the case that it is determined that said battery is mounted on said battery storage part.

* * * * *